United States Patent [19]

Jordan et al.

[11] Patent Number: 4,960,219

[45] Date of Patent: Oct. 2, 1990

[54] SNAP CAP

[75] Inventors: Willie W. Jordan; Brian J. McGraw, both of Garland, Tex.

[73] Assignee: Abbott Laboratories, Abbott Park, Ill.

[21] Appl. No.: 404,842

[22] Filed: Sep. 8, 1989

[51] Int. Cl.[5] ..... B65D 41/00

[52] U.S. Cl. ..... 215/354; 215/320; 215/DIG. 3; 220/355

[58] Field of Search ..... 215/320, 354, 364, DIG. 3, 215/317, 321; 220/255, 278, 287, 355, DIG. 19

[56] References Cited

U.S. PATENT DOCUMENTS

| | | | |
|---|---|---|---|
| 2,554,173 | 5/1951 | Alexanian | 220/278 X |
| 2,655,282 | 10/1953 | Dunbar | 220/21 |
| 2,743,834 | 5/1956 | Williams | 215/354 |
| 2,949,204 | 8/1960 | Edwards | 215/41 |
| 2,992,501 | 7/1961 | Douglas | 220/23.8 |
| 3,021,001 | 2/1962 | Donofrio | 206/56 |
| 3,085,705 | 4/1963 | Varney | 215/317 |
| 3,098,721 | 7/1963 | Jewell | 220/255 X |
| 3,139,208 | 6/1964 | Irwin et al. | 220/23.3 |
| 3,202,448 | 8/1965 | Stern et al. | 215/321 X |
| 3,302,854 | 2/1967 | Midgley et al. | 215/321 X |
| 3,442,377 | 5/1969 | Angelus | 220/DIG. 19 X |
| 3,521,785 | 7/1970 | Bergmann et al. | 220/23.4 |
| 3,601,253 | 8/1971 | Poupitch | 206/65 E |
| 3,607,098 | 9/1971 | Strande | 215/317 X |
| 3,923,155 | 12/1975 | Tanzer | 206/427 |
| 3,994,410 | 11/1976 | Pirgov et al. | 215/320 |
| 4,291,803 | 9/1981 | Perales | 206/443 |
| 4,310,488 | 1/1982 | Rahm et al. | 422/102 |
| 4,348,207 | 9/1982 | Cappel | 23/230 |
| 4,480,762 | 11/1984 | Thomas | 215/273 |
| 4,551,308 | 11/1985 | Mintz | 422/58 |
| 4,599,314 | 7/1986 | Shami | 435/287 |
| 4,608,231 | 8/1986 | Witty et al. | 422/61 |
| 4,675,299 | 6/1987 | Witty et al. | 436/165 |
| 4,678,752 | 7/1987 | Thorne et al. | 435/291 |
| 4,799,599 | 1/1989 | Herrmann | 215/307 |
| 4,829,006 | 5/1989 | Smith et al. | 215/354 X |
| 4,845,038 | 7/1989 | Barr et al. | 215/354 X |
| 4,855,110 | 8/1989 | Marker et al. | 422/102 |

FOREIGN PATENT DOCUMENTS 1565458 1/1968 France .

*Primary Examiner*—Stephen Marcus
*Assistant Examiner*—Nova Stucker
*Attorney, Agent, or Firm*—Roberta L. Hastreiter

[57] ABSTRACT

A snap cap apparatus is provided for sealing individual or a plurality of containers having necked openings. The snap cap apparatus comprises one or more caps, each cap having a pliable cover, the cover supporting one or a plurality of caps for sealing corresponding containers having necked openings. The snap caps providing a chamber and concentrically positioned within the chamber are stopper elements with a base connected to the thin pliable cover. The stopper elements terminating in an exposed end portion which is tapered to a smaller dimension than the base, the exposed end portion being positioned proximal to the open end of the chamber of the cap, the cap and stopper element combining to define an open ring portion for receiving container opening neck portions.

20 Claims, 2 Drawing Sheets

SNAP CAP

FIELD OF THE INVENTION

The invention relates to snap cap apparatus suitable for closing and sealing containers having necked openings. In another aspect the invention relates to snap cap apparatus for closing and sealing a group of containers having necked openings which are arranged in a predetermined geometric relationship. In yet another aspect the invention relates to an apparatus for closing and sealing a group of reagent-containing vials arranged in a reagent pack for use with automated clinical analyzer apparatus.

BACKGROUND OF THE INVENTION

In many scientific fields inclusive of biology, chemistry, physics, medicine and pharmacology, small amounts of various fluids of high monetary and research value are maintained in containers having necked openings such as vials which here before have been sealed with threaded cap devices and other means of a more permanent nature. These high value fluid materials require safe and more readily available access than afforded by for example a srew on cap. In addition, frequently several vials of related vials of reagents necessary for specific laboratory testing and the like are maintained in close proximity, for example, in predetermined clusters or racks. In the field of diagnostic testing of biological fluids for the presence of drugs, viral disease, bacterial infections and the like, samples are collected, reacted with reagents, and the results of the reactions analyzed using well known techniques. The reagents used in such tests are typically purchased in and drawn from vials or other containers which are often arranged for convenience in pre-formed packs having a plurality of such vials containing the reagents required for a specific test. Typically, samples of body fluids such as serum, plasma, urine and the like are assayed for the presence of analytes such as drugs, viruses or bacteria by reacting the samples according to a specific test protocol with specific reagents which are selected to identify a particular analyte. The protocol specifies the sequence in which sample and reagent are to be introduced, the timing of the introduction of sample and reagents, the volumes of each to be used and other conditions to be controlled such as temperature. The resulting reaction mix is typically allowed to incubate for a predetermined time and then read, optically or otherwise to determine the presence of concentrations of the specific analyte which the assay is designed to identify. In general, procedures and apparatus for preparing and reading immunoassays are well known.

For economy and practicality, each vial typically contains sufficient amounts of reagent to test a number of samples. Multiple dose reagent pack and carousels for automated clinical analyzer systems are known wherein the reagent pack is adapted to function within the carousel, the carousel holding such packs together with a plurality of conventional sample containers which contain samples to be assayed by the analyzer. These reagent packs include a vial carrier having a plurality of vial receiving wells for containing a corresponding plurality of muli-dose reagent-containing vials. The carousel includes a base for rotably mounting in an analyzer and a rack which is connected to the base and which has a plurality of predetermined mounting positions which are adapted to releasably mount the reagent packs or reagent vials in selected positions.

Automated clinical analyzers are capable of performing immunoassays on an entire batch of samples simultaneously. In some types of known analyzers, such as the well known TDx® clinical analyzer manufactured by Abbott Laboratories of North Chicago, Ill., a batch of sample containers are mounted radially about a ratable carousel together with a corresponding number of reaction containers. The carousel is then mounted inside the analyzer. Inside the analyzer, the carousel rotates step wise to move each corresponding sample container and reaction container pair first to a position adjacent a preparation station, and then to a second position adjacent a reading station. A mechanical apparatus having pipetting means and typically operating under program control is located in proximity to the preparation station. Also located in proximity to the preparation station are a plurality of reagent containers which contain the reagents required to perform a specific immunoassay on the batch of samples contained in the sample containers. The reagent containers may be individual containers or may be configurated as an integrated pack.

At the preparation station, the mechanical apparatus and pipetting means operate to access and transfer volumes of sample from a sample container and reagents from the reagent containers into a reaction container according to the protocol established for the specific assay. When the mechanical apparatus completes the preparation of the reaction mix according to the test protocol the carousel rotates, positioning the next corresponding sample container and reaction container pair adjacent to preparation station and moving the previous pair toward the reading station. Known carousels typically hold between 20 and 25 sample containers.

One limitation of a number of these analyzers is that they are capable of performing only one assay at a time on each batch of samples on the carousel. In order to perform a different assay, it is necessary to physically remove the reagent containers either individually or as a pack from the analyzer and replace them with different reagent containers or a different pack for the assay to be run. The requirement of changing reagent packs for each assay has an adverse impact on throughput of the analyzer. However, more recently multi-dose reagent packs have been provided which can be expediently mounted on a carousel with a plurality of sample containers to provide reagents for conducting immunoassays of a plurality of such samples. The carousels are adapted to hold a plurality of such multi-dose reagent packs interspersed with such sample containers to flexibly provide reagents for performing the same or different assays on the same or different samples. Flexibility has been achieved in providing apparatus and methodology wherein a selected plurality of different assays on the same or different samples may be achieved as well as selectably vary the number of different assays performed on each sample while maintaining high throughput levels and reducing the requirement for physical interaction with the analyzer and the carousel.

A problem with such multi-dose reaction packs, multi-sample carousel analyzer apparatus is that once opened, the reagents may become contaminated. For example, the properties of certain reagents may be affected by exposure to light or air, the passage of time, or exposure to other reagents or contaminates.

The vials of such packs could be individually reclosed using individual screw on or other closures typically provided with such vials. However, such individual closures can be misplaced or lost when separated from the respective vials. In addition, it is time consuming and in convenient to individually open and reclose each vial of a pack with a separate closure, particularly in an automatic testing environment where test set up time and the time between tests can have a critical impact on throughput.

A need exists for a snap cap apparatus that provides expedient, economical, secure and safe resealing of individual or multiple dose reagent vials once the vials have been opened. A desirable feature of such apparatus is to provide resealing of a group of vials arranged in a reagent pack. Another needed feature is to provide an apparatus which minimized contamination during handling and loss of seal during the useful life of the reagents. It is advantageous to provide a sealing apparatus that remains attached to the vials of the reagent pack during use of other reagent packs in an automated clinical analyzer without interfering with other assay protocol operations.

SUMMARY OF THE INVENTION

The present invention seeks to overcome the foregoing limitations and problems associated with screw on or other closures typically provided with containers having necked openings. The apparatus according to the invention provides expedient, economical and safe resealing as well as resealable snap cap seals for containers having necked openings such as vials contained in reagent packs. For purposes of discussing this invention, the snap cap apparatus will be focused on its adaptation for sealing and closing of vials contained in reagent packs either individually or in groupings of prearranged geometric adaptations. The snap cap apparatus of the invention is adapted to be removably attached to the vials throughout storage, as well as when the reagent pack is in use position but sealed until needed. In addition, the snap cap apparatus once attached can form a single unit with its associated reagent pack wherein the snap cap apparatus is predesigned and arranged so that the caps and stopper elements are applicable to a specific geometry of the associated reagent pack positioned vials.

The snap cap apparatus can be comprised of a number of cap and stopper elements which in combination are attached to a thin, pliable connecting cover in a planer or multi-planer arrangement corresponding to the openings of a number of reagent-containing vials in a reagent pack. The cover is capable of being adapted for different planes to accommodate vials of different heights or mounting heights within the reagent pack. The snap cap apparatus stopper elements being constructed of pliable materials can be readily inserted and removed from the openings of corresponding vial necks. The snap cap in cooperation with the stopper element define an open ring portion for receiving container opening neck portions with the stopper element being inserted into the container opening and the cap walls surrounding and gripping the outer container neck portion. The caps present a series of open chambers which are adapted to fit over and around the necks of the reagent-containing vials while the stoppper element is positioned for insertion into the opening of the vials in such a dimensional relationship that the snap cap apparatus is capable of capping and sealing while being capable of removal without disturbing the reagent or the reagent containing vials which are affixed in the reagent pack.

BRIEF DESCRIPTION OF THE DRAWINGS

The features which are believed to characterize the invention are set forth in the appended claims. The invention itself, together with further features and intended advantages, will be best understood by reference to the following detailed description of the embodiments thereof, taken in conjunction with the accompanying drawings, in which:

DETAILED DESCRIPTION

Figure 1:
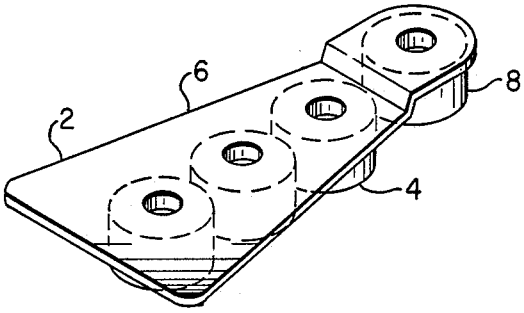
FIG. 1 is a prospective view of a snap cap apparatus of the present invention suitable for closing and sealing vials presenting necked openings on different planer levels.
Figure 2:
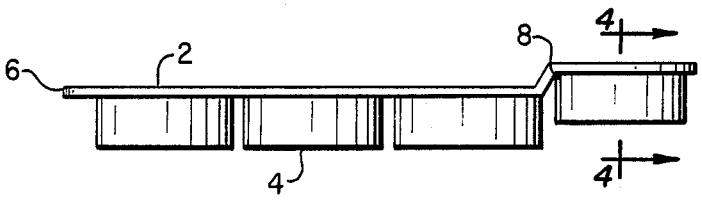
FIG. 2 is a side view of the bi-planer snap cap apparatus of FIG. 1.
Figure 3:
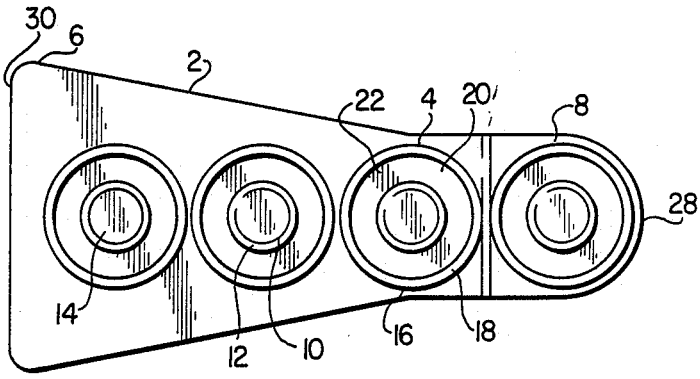
FIG. 3 is a bottom view of the snap cap apparatus of FIGS. 1 and 2 illustrating the snap caps in linear relationship as well as the tapering of the cap walls and the stopper elements.

Referring to the drawings, FIGS. 1 through 7 illustrate two embodiments of the snap cap apparatus as applicable to multiple dose reagent packs utilized within a carousel environment for automated analyzation and testing of various sample fluids. As seen in FIGS. 1 through 3 a bi-planer snap cap apparatus 2 incorporating four snap caps 4 is illustrated wherein a prearranged multiple vial reagent pack can be covered with one apparatus wherein the closures are suitable for sealing and quick removal. The bi-planer snap cap apparatus 2 provides for the adaptation of one continuous snap cap configuration wherein one vial neck opening to be sealed and capped is elevated in relationship to the other three. The thin pliable connecting cover can be adapted as shown in FIGS. 1 through 3 to accommodate the different elevated vial necks or carousel elevated vials. The elevated snap cap 8 is only one embodiment wherein the reagent pack presents a vial opening at different heights. The snap cap apparatus can also be designed to embody snap caps of different size and shape mounted on the same connecting cover. In the bottom view of FIG. 3, the stopper element 10 is shown with a stopper element base 12 having stopper element tapered exposed end 14. The cap wall 16 provides in cooperation with connecting cover a cap chamber 20 wherein the stopper element is mounted. The cap wall 16 has an end portion taper 18 which acts as a mounting guide when brought into contact with the neck opening of various containers. In addition, the stoper element tapered exposed end 14 acts as a mounting and pluging guide when brought into contact with container opening. The cap wall 16 in cooperation with the stopper element 14 define a ring-like opening 22 which receives the to be sealed container necked opening portion for capping and sealing.

Figure 4:
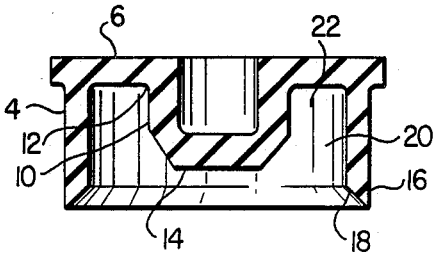
FIG. 4 is a sectional view of FIG. 2 along lines 4—4 which is a more detailed illustration of the tapered opening of the cap chamber walls, the tapered stopper end portion and the open ring portion for receiving neck portions of the container openings.

In FIG. 4, an end sectional view along the lines of 4—4 of FIG. 2 the stopper element tapered exposed end 14 is illustrated in a plane slightly above the opening of the cap wall 16. In general, the stopper element tapered exposed end 14 is proximal to the opening of the cap chamber 20. These two elements, i.e., the tapered exposed end 14 of the stopper element and the cap wall end portion taper 18 cooperate in providing smooth and expedient capping and sealing of the necked openings of the containers to be sealed. The taper of the stopper element 10 allows for easy entry of the stopper into the opening of the receiving container neck. The cap wall end portion taper likewise allows for expedient mounting of the walls over the exterior of the necked opening of the container.

In a preferred embodiment, the dimensions of the pliable snap cap are precisely provided in a relationship to the container neck portion to be sealed in order for total initial sealing and long term sealing under normal environmental use conditions. For example, the stopper element 10 at the base 12 is of a diameter or dimension which is slightly larger than the orifice of the container to be sealed. In cooperation with this dimensional aspect, the cap wall defines a chamber which is of a diameter or dimension equal to or slightly smaller than the outer diameter or dimension of the container necked portion whether than outer dimension surface is smooth or threaded. Such dimensional relationships to the necked opening of the container to be capped and sealed is most desirable in order to afford satisfactory long term capping and sealing and yet allows for short term removal of the snap cap apparatus from the container neck portion and opening.

Figure 5:
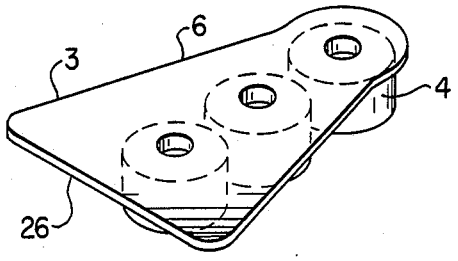
FIG. 5 is a top prospective of the snap cap apparatus of the present invention illustrating a planer three reagent vial capping apparatus.
Figure 6:
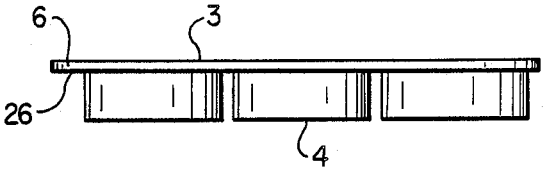
FIG. 6 is a side view of the three-vial snap cap apparatus of FIG. 5.
Figure 7:
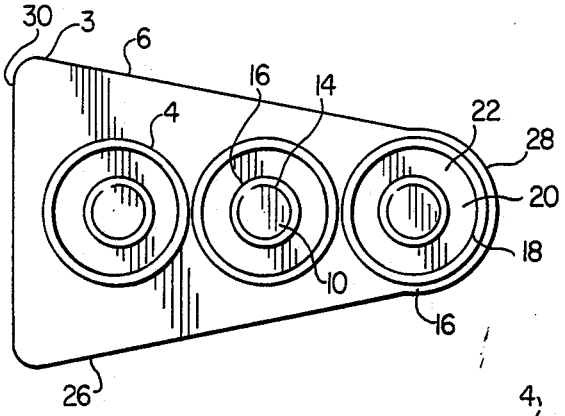
FIG. 7 is a bottom view of the three snap cap apparatus of FIGS. 5 and 6.

FIGS. 5 through 7 provide a planer adaptation utilizing three snap caps as a unit which would be suitable for a linear arrangement of a reagent pack containing three vials. Finger tab elements 26 being an extension of the thin pliable connecting cover 6 afford a suitable apparatus and method for removing the snap cap apparatus from a sealing engagement of the reagent containing vials. In addition, the snap cap apparatus 3 as well as the bi-planer snap cap apparatus 2 can be arranged in any geometrical format, however, as shown in FIGS. 1 through 7 the apparatus is flanged in such a way that it has an inner end 28 and a broader outer end 30 inclusive of the finger tab portions 26.

Figure 8:
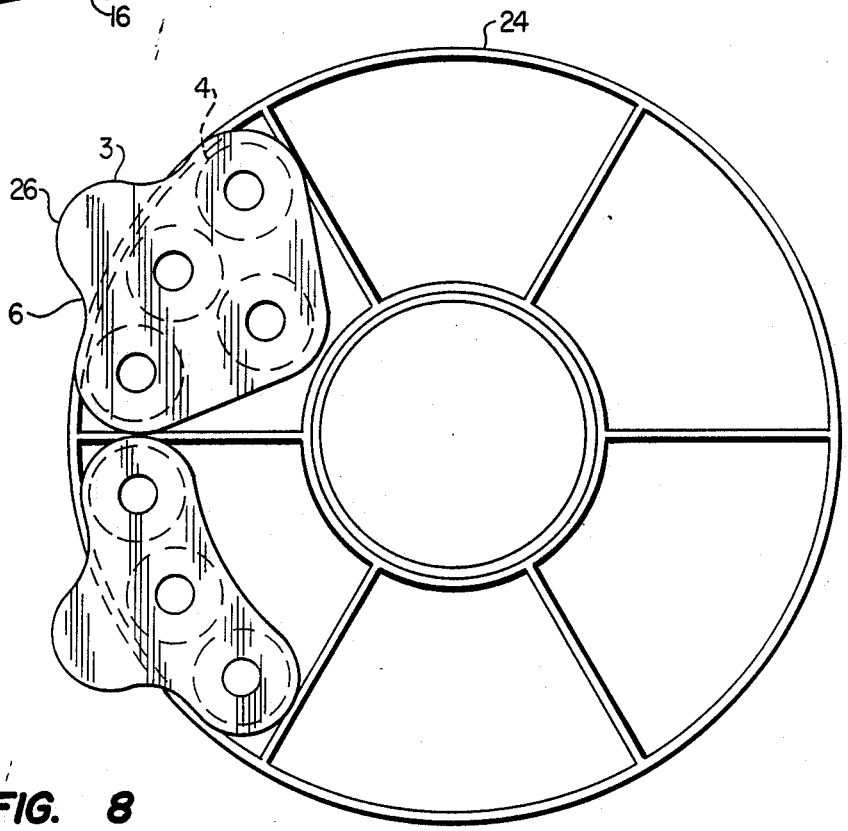
FIG. 8 is a top plan view illustrating alternative configurations of the snap cap apparatus which would be amenable to selectively covering non-linear reagent pack vials of neighboring reagent packs in place on a carousel apparatus.

FIG. 8 illustrates a very simplistic view of a carousel concept with the snap cap apparatus according to the invention being shown in non-linear relationships with vials and reagent packs (not shown). The thin pliable connecting cover 6 can be arranged with various snap caps 4 to only cover and seal selected vials contained in one or more reagent packs or sealing vials in neighboring reagent packs while sealing one or more vials in a single reagent pack. The purpose of FIG. 8 is to show the broader scope and utilization of the snap cap apparatus according to the invention wherein the various snap cap configurations can be designed for multiple purposes since the caps are connected with a thin pliable cover having handling means for sealing and unsealing snap caps from the vial necked orifices.

Application of the snap cap apparatus according to the invention when directed to sealing of vials contained in a reagent pack or reagent packs are designed and molded in specific geometric format in order to accommodate the reagent pack positioning. Each of the stopper elements 10 correspond to an opening of a vial which is mounted in a reagent pack. The stopper elements 10 and cap chamber 20 are positioned on the thin pliable connecting cover which generally has in this environment an inner end 28 and an enlarged outer end 23 which is of assistance to the operator in readily assessing the proper position for capping and sealing the particular configuration of reagent pack mounted vials. Specific configurations of the thin pliable connecting cover and snap caps will avoid error and misuse of the snap cap apparatus according to the invention. The snap cap apparatus is provided with finger tab or grip surfaces proximate to the outer end 30 wherein the finger tab 26 portions provide in cooperation with the thin pliable connecting cover 6, means for opening and closing the snap cap apparatus 3 without touching the stopper element 10 or cap chamber wall 16, thereby minimizing contamination of the reagents. The apparatus according to the invention is constructed and formed of pliable plastic materials which allows for slight deformation of the cap chamber 20 and the stopper element 10 in order to achieve desired capping and sealing of the reagent pack vials. The stopper element 10 and cap chamber 20 defined a ring 22 which provide when inserted in the vial necked opening through flexiblity of material a secure fluid-tight press fit in and around the necked openings of the containers or vials to be sealed. The fluid-tight cap and seal provided by the snap cap apparatus prevents contaminates of the reagent by other reagents, samples or the environment.

The reagent containing vials which are fixed in the multi-dose reagent packs are generally formed at minimum cost of thin, flexible plastic by conventional plastic molding techniques. Alternatively, glass or other vials are used in the industry. The vials are generally cylindrical in shape and have a verticle dimension sufficient to elevate the neck and opening of the vial above the reagent pack surface. This elevated neck portion provides for ease of access to the vial when mounted in the pack. Dimensionally, these vials can have a capacity of approximately 2.5 milliliters of selected reagent which is typically sufficient to perform assays on approximately 50 samples. The vials are suitably provided with conventional threaded or capped enclosures, and may, after being opened being resealed with the snap cap apparatus of the present invention. Although it would be possible to form the vials integrally with the vial reagent pack carrier it is preferred that the two components be embodied separately. Separate vials are easier to fill and avoid the risk of contaminating the reagent in one vial with reagent from adjacent vials during the filling process. Also the vials when secure in the reagent pack mechanism become a single unit for use purposes; however, when the reagents in the vials are expended, the individual vials or even the entire reagent pack including the vials are disposable.

A supplier of reagents can economically provide reagents for specific assays to the operator of an automated analyzer in a conventional unitary reagent pack. Thus, for example, the operator can purchase reagent packs for cocaine or other drug tests, the packs received by the user will contain all the necessary reagents for each desired assay.

Generally, the three vial embodiment of the reagent pack is best suited for use in assays of the type requiring a pretreatment reagent usually used to bind the analyte of interest from certain proteins in the sample, an analyte compliment for binding the unbound analyte, and a specifically tagged or labelled tracer reagent for indicating the presence of the analyte of interest. Each of the required reagents is contained in one of the vials of the reagent pack.

The four vial embodiment is particularly well suited for use in certain assays of the type described above but which are particularly sensitive to carry over of any reagent, for example by pipetting means of an analyzer from one reagent vial to another. Examples include assays for marjiuana, cocaine and amphetamines. For such assays the fourth vial of the pack is advantageously provided to contain a wash or buffer reagent that can be used to rinse the pipe heading means after it accesses such reagent.

Multi-dose reagent packs and the various reagent containing vials along with corresponding carousel apparatus for use with automated analyzers provide the operator the ability for an entire battery of drug tests and other biological fluid tests which is automatically carried out on the same or different person groups. Obviously, many arrangements of combinations of samples, groupings of samples and reagent packs can be made thus increasing the complexity of the system. With such complexities the need for snap cap apparatus for capping and sealing reagent vials during periods of nonuse without interfering with the other functions of the automated equipment is a must. Not only must the vials be capped and sealed with ease, movement of the snap cap apparatus must also be achievable without disturbing the vials in their fixed placement in the reagent packs.

In a preferred embodiment, the snap cap apparatus are arranged linearly to accommodate a linear arrangement of vials when mounted in a reagent pack. Other geometries may also be used to accommodate various reagent pack configurations. The snap caps inclusive of the stopper element and the cap chamber as mounted on the pliable cover are at spacings corresponding to the spacings of the necks of the individual vials allowing proper placement and snap capping and sealing. While it may be desirable for the snap cap apparatus to be disposed of when the vials are empty, the snap cap apparatus is removable and could be cleaned and used with another reagent pack.

While the invention has been described in connection with the presently preferred embodiments thereof, it will be apparent to those skilled in the art that various changes and modifications to the structure, arrangement, proportions, elements, materials and components used in the practice of the invention are possible without departing from the scope and spirit of the invention. The foregoing description is therefore to be taken as illustrative rather than limiting and the scope of the invention is described solely by the following claims and their equivalents.

We claim:

1. A snap cap apparatus for containers having necked openings comprising:

a plurality of caps, each cap defining an open chamber with an open end having wall thickness tapered from outside to inside, the caps being arranged and connected by a thin pliable cover which forms with the wall a closed end and in cooperation with the wall defines the chamber;

the caps having stopper elements concentrically positioned within the chamber, the stopper elements each having a base connected to the thin pliable cover and presenting a smaller tapered exposed end portion which is proximal to the open end of the chamber, the cap and stopper element defining an open ring portion for receiving container opening neck portions.

2. The snap cap apparatus according to claim 1 wherein the plurality of caps having stopper elements concentrically positioned within said caps are of different dimensions from one snap cap to another including different cross section dimension and depth of cap chamber and stopper elements.

3. The snap cap apparatus according to claim 1 wherein the caps and stopper elements concentrically positioned therein are linearly arranged and connected by a thin, pliable cover, said pliable cover generally conforming to a reagent pack containing necked vial openings into which said stopper elements are to be inserted and the snap cap apparatus providing an open ring portion for receiving the vial neck portions.

4. The snap cap apparatus according to claim 1 wherein the thin pliable cover provides extended surface beyond the snap cap locations for handling means.

5. The snap cap apparatus according to claim 1 wherein the thin pliable cover containing the snap caps has a first and second surface, with the snap caps mounted on a first surface and projecting away from said first surface while the second surface is generally planer and is outwardly flanged from an inner end.

6. The snap cap apparatus according to claim 1 wherein the stopper elements tapered exposed end portions are recessed within the chamber from the chamber open end.

7. The snap cap apparatus according to claim 1 wherein the stopper elements base is larger than the tapered exposed end portion and the tapered end portion begins approximately midway between the base and the smaller tapered exposed end portion.

8. The snap cap apparatus according to claim 1 wherein the stopper elements have a maximum cross sectional dimension which is equal to or slightly larger than the cross sectional dimension of the inside of the container necked opening.

9. The snap cap apparatus according to claim 1 wherein the cap wall defines a cross sectional dimension which is equal to or slightly smaller than the cross sectional dimension of the exterior of the necked portion of the containers.

10. The snap cap apparatus according to claim 1 wherein the plurality of caps are arranged in a non-linear relationship on the thin pliable cover.

11. A snap cap apparatus for containers having necked openings comprising:

a cap defining an open chamber with an open end having wall thickness and a wall open end portion which tapers axially and laterally inwardly in relationship to the chamber from the outer diameter to the inner diameter of said wall, the wall mounted to a thin pliable cover which forms a closed end of the chamber and in cooperation with the wall, defines the chamber;

the cap having a stopper element concentrically positioned within the chamber, the stopper element having a base connected to the thin pliable cover and presenting a smaller tapered side wall terminating into an end wall which is proximal to the open end of the chamber, the cap and stopper element defining an open ring portion for receiving container opening neck portions.

12. A snap cap apparatus for containers having necked openings comprising a plurality of caps, each cap defining an open ended cylindrical chamber with the open end presenting a cylindrical wall which is tapered from outside diameter inwardly to the inside diameter, the caps being arranged on a thin pliable cover which forms with the wall a closed end of the cylindrical chamber; the caps having stopper elements mounted concentrically within the cylindrical chamber, the stopper elements each having an exposed cylindrical end portion connected to an enlarged cylindrical base through an inverted conical section, the stopper elements being connected at the base to the thin pliable cover; the stopper elements having a smaller diameter than the inside diameter of the cap, the cap and stopper element defining an open ring portion for receiving neck portions of the container openings.

13. The snap cap apparatus according to claim 12 wherein the caps and stopper elements concentrically positioned therein are linearly arranged and connected by thin pliable cover, said pliable cover generally conforming to a reagent pack containing necked vial openings into which said stopper elements are to be inserted and the snap cap apparatus providing an open ring portion for receiving the vial neck portions.

14. The snap cap apparatus according to claim 12 wherein the thin pliable cover provides extended surface beyond the snap cap locations for handling means.

15. The snap cap apparatus according to claim 12 wherein the thin pliable cover containing the snap caps has a first and second surface, with the snap caps mounted on a first surface and projecting away from said first surface while the second surface is generally planer and is outwardly flanged from an inner end.

16. The snap cap apparatus according to claim 12 wherein the stopper elements tapered exposed end portions are recessed within the cylindrical chamber from the cylindrical chamber open end.

17. The snap cap apparatus according to claim 12 wherein the stopper elements base is larger than the exposed end portion which is connected to the base through an inverted conical section with said section beginning approximately midway between the base and the smaller exposed end portion.

18. The snap cap apparatus according to claim 12 wherein the stopper elements have a maximum cross sectional dimension which is equal to or slightly larger than the cross sectional dimension of the inside of the container necked opening.

19. The snap cap apparatus according to claim 12 wherein the cap wall defines a cylindrical cross sectional dimension which is equal to or slightly smaller than the cylindrical cross sectional dimension of the exterior of the necked portion of the containers.

20. The snap cap apparatus according to claim 12 wherein the plurality of caps are arranged in a non-linear relationship on the thin pliable cover.

* * * * *